US007040111B2

(12) United States Patent
Lee et al.

(10) Patent No.: US 7,040,111 B2
(45) Date of Patent: May 9, 2006

(54) ICE SUPPLYING DEVICE OF REFRIGERATOR

(75) Inventors: Wook Yong Lee, Gyeonggi-do (KR); Myung Ryul Lee, Gyeonggi-do (KR); Seung Hwan Oh, Seoul (KR); Fui Yeop Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/799,732

(22) Filed: Mar. 15, 2004

(65) Prior Publication Data

US 2005/0061017 A1 Mar. 24, 2005

(30) Foreign Application Priority Data

Sep. 18, 2003 (KR) ..... 10-2003-0064840

(51) Int. Cl.
*F25C 5/18* (2006.01)

(52) U.S. Cl. ..... 62/344; 22/146.6

(58) Field of Classification Search ..... 62/344; 222/146.6

See application file for complete search history.

(56) References Cited

U.S. PATENT DOCUMENTS

| | | | | |
|---|---|---|---|---|
| 3,146,601 | A * | 9/1964 | Gould | 62/3.6 |
| 3,747,363 | A * | 7/1973 | Grimm | 62/377 |
| 4,209,999 | A | 7/1980 | Falk et al. | |
| 4,614,088 | A | 9/1986 | Brooks | |
| 4,838,026 | A | 6/1989 | Searl | |
| 5,050,777 | A | 9/1991 | Buchser | |
| 5,117,654 | A * | 6/1992 | Steffenhagen | 62/344 |
| 5,273,219 | A | 12/1993 | Beach, Jr. et al. | |
| 5,526,854 | A | 6/1996 | Unger | |
| 5,992,167 | A | 11/1999 | Hill et al. | |
| 6,050,097 | A | 4/2000 | Nelson et al. | |
| 6,082,130 | A | 7/2000 | Pastryk et al. | |
| 6,135,173 | A | 10/2000 | Lee et al. | |
| 6,148,624 | A | 11/2000 | Bishop et al. | |
| 6,286,324 | B1 | 9/2001 | Pastryk et al. | |
| 6,314,745 | B1 | 11/2001 | Janke et al. | |
| 6,351,958 | B1 | 3/2002 | Pastryk et al. | |
| 6,442,954 | B1 | 9/2002 | Shapiro et al. | |
| 2001/0025505 | A1 | 10/2001 | Nelson et al. | |

FOREIGN PATENT DOCUMENTS

| | | |
|---|---|---|
| EP | 0 940 642 A2 | 2/1999 |
| JP | 5118723 A | 5/1993 |
| JP | 11248319 A | 9/1999 |

* cited by examiner

*Primary Examiner*—William E. Tapolcai
(74) *Attorney, Agent, or Firm*—Birch, Stewart, Kolasch & Birch, LLP

(57) ABSTRACT

An ice supplying device of a refrigerator is disclosed, which has a structure a container is easily mounted in a door, or separated from the door. The ice supplying device includes an icemaker for making ice with a cool air of a freezer; a container mounted in a door in perpendicular to the inside of the door, the door for opening or closing the freezer, and provided below the icemaker for storing the ice when the door is closed; a dispenser provided on an outer surface of the door; and an ice chute provided in the door so as to connect the container and the dispenser with each other.

19 Claims, 9 Drawing Sheets

ICE SUPPLYING DEVICE OF REFRIGERATOR

This application claims the benefit of the Korean Application No. P2003-64840, filed on Sep. 18, 2003, which is hereby incorporated by reference.

BACKGROUND OF THE INVENTION

1. Field of the Invention

The present invention relates to a refrigerator, and more particularly, to an ice supply device having an improved structure for detachably mounting a container in a door.

2. Discussion of the Related Art

A refrigerator is an apparatus for storing foods freshly for a long time, in which a food storage chamber is provided. The food storage chamber is always maintained at a low temperature by a refrigerating cycle for keeping foods fresh.

The food storage chamber is divided into a plurality of storage chambers having different characteristics from each other such that a user can choose a food-storage method in due consideration of the kind, characteristic and expiration date of food. Typical examples of the storage chambers are a cooling chamber and a freezer.

The cooling chamber keeps a temperature at about 3° C.–4° C. for keeping foods and vegetables fresh for a long time. The freezer keeps a temperature at a sub-zero temperature for keeping and storing meat and fish frozen for a long time, and making and storing ice.

In the meantime, the refrigerator is developed for performing various additional functions besides a typical function thereof. For example, the user had to open a door and take out a water bottle kept in the cooling chamber so as to drink cold water.

However, a refrigerator having a water dispenser provided at the outside of the door has been recently developed. That is, it is possible to provide the water cooled by a cool air of the cooling chamber to the user without opening the door. Furthermore, a product with water purifying function being added to the water dispenser is being supplied.

Also, when the user wants to drink water or beverage with the ice, the user has to open the door of the freezer, and use the ice by separating the ice stored in an ice tray therefrom, thereby generating a user's inconvenience. In addition, when the door is open, the cool air of the freezer leaks out, whereby a temperature of the freezer goes up. Accordingly, a compressor is required to work more, so that it has a problem of wasting energy.

SUMMARY OF THE INVENTION

Accordingly, the present invention is directed to an ice supplying device of a refrigerator that substantially obviates one or more problems due to limitations and disadvantages of the related art.

An object of the present invention is to provide an ice supplying device of a refrigerator, for supplying ice to a user in the outside without opening a door.

Another object of the present invention is to provide an ice supplying device of a refrigerator having an improved structure for mounting or separating a container in a door, and improving efficiency in using an inside space of a freezer.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an ice supplying device of a refrigerator includes an icemaker for making ice with a cool air of a freezer; a container mounted in a door in perpendicular to the inside of the door, the door for opening or closing the freezer, and provided below the icemaker for storing the ice when the door is closed; a dispenser provided on an outer surface of the door; and an ice chute provided in the door so as to connect the container and the dispenser with each other.

At this time, the icemaker may be mounted in the door or the freezer. Also, the container is mounted in the door by sliding along a perpendicular direction of the inside of the door, or separated from the door.

The icemaker includes an ice tray receiving water therein; a water supplying part for supplying the water to the ice tray; an ejector provided adjacent to the ice tray, and being rotated so as to discharge the ice of the ice tray; and a strip being extended from the ice tray, and guiding the ice discharged by the ejector to the container.

Meanwhile, the strip partially covers an upper part of the ice tray so as to prevent the water in the ice tray from overflowing when the door is opened or closed. Furthermore, the ice supplying device includes a panel being extended from the upper part of the ice tray upward so as to prevent the water in the ice tray from overflowing when the door is opened or closed.

The container includes an outlet provided at one side thereof; and a transporting device being rotated by a motor, and provided in the container so as to transport the ice stored in the container to the outlet. At this time, the transporting device is formed of an auger crossing the inside of the container. The auger is provided in perpendicular to the inside of the door.

The container is positioned adjacent to the outlet, and has a crusher for crushing the ice transported by the transporting device. In this case, the crusher includes a shaft being rotated in the container; and at least one blade being extended from the shaft, and being rotated with the shaft so as to crush the ice.

Meanwhile, the shaft and the transporting device being connected to each other are rotated together. The motor is mounted in the door. In this case,the motor and the transporting device are connected to each other by a gear assembly, the gear assembly having a first gear connected to the motor, and a second gear connected to the transporting device and engaged with the first gear. Also, the motor and the transporting device are connected to or separated from each other when the container is mounted in the door, or separated from the door.

Also, the ice supplying device further includes an ice discharger provided below the container, so as to control an opening or closing amount of the outlet. In this case, the ice discharger includes an actuator being operated according to a signal of a controller; and a shutter for controlling the opening or closing amount of the outlet according to the operation of the actuator.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, an ice supplying device of a refrigerator according to the present invention will be described with reference to the accompanying drawings.

Figure 1:
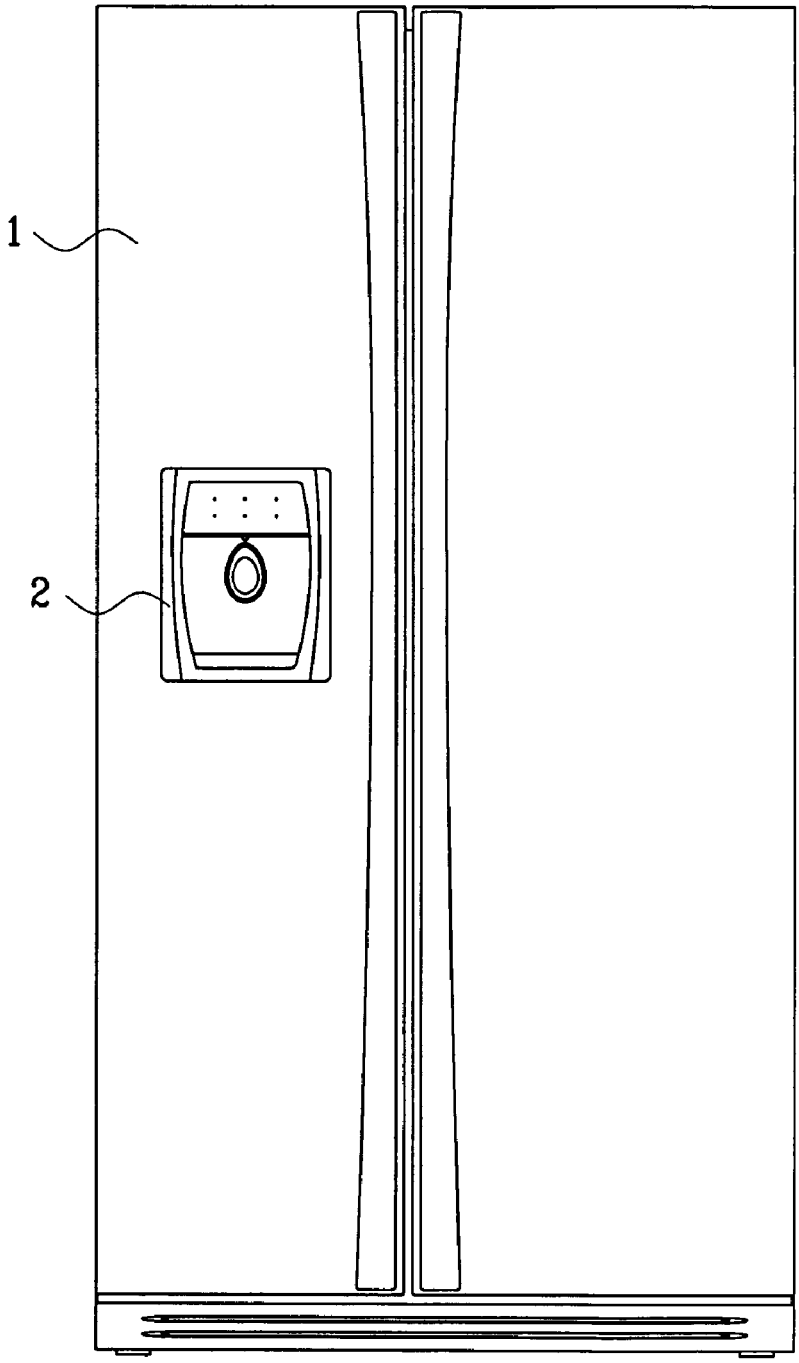
FIG. 1 is a front view illustrating a refrigerator having an ice supplying device according to the present invention.

FIG. 1 is a front view illustrating a refrigerator having an ice supplying device according to the present invention. In FIG. 1, the refrigerator includes a cooling chamber and a freezer. Also, a door 1 is mounted on the front of the refrigerator, and a dispenser 2 is provided in the door 1 so as to supply ice to a user in the outside of the door 1. Furthermore, an ice supplying device is provided in the door 1 and the freezer so as to supply ice to the dispenser 2.

Although not shown, a water tank may be provided in the cooling chamber so as to supply cold water to the dispenser 2. However, it is possible to provide an additional dispenser connected to the water tank in another door for opening and closing the cooling chamber, so as to supply only water.

Accordingly, the dispenser 2 enables the user to be supplied with the water or ice in the outside without opening the door 1. Hereinafter, the ice supplying device according to the present invention will be described in detail, the ice supplying device for supplying the ice to the dispenser 2. For reference, FIG. 2 to FIG. 5 illustrate the ice supplying device according to the first embodiment of the present invention.

Figure 2:
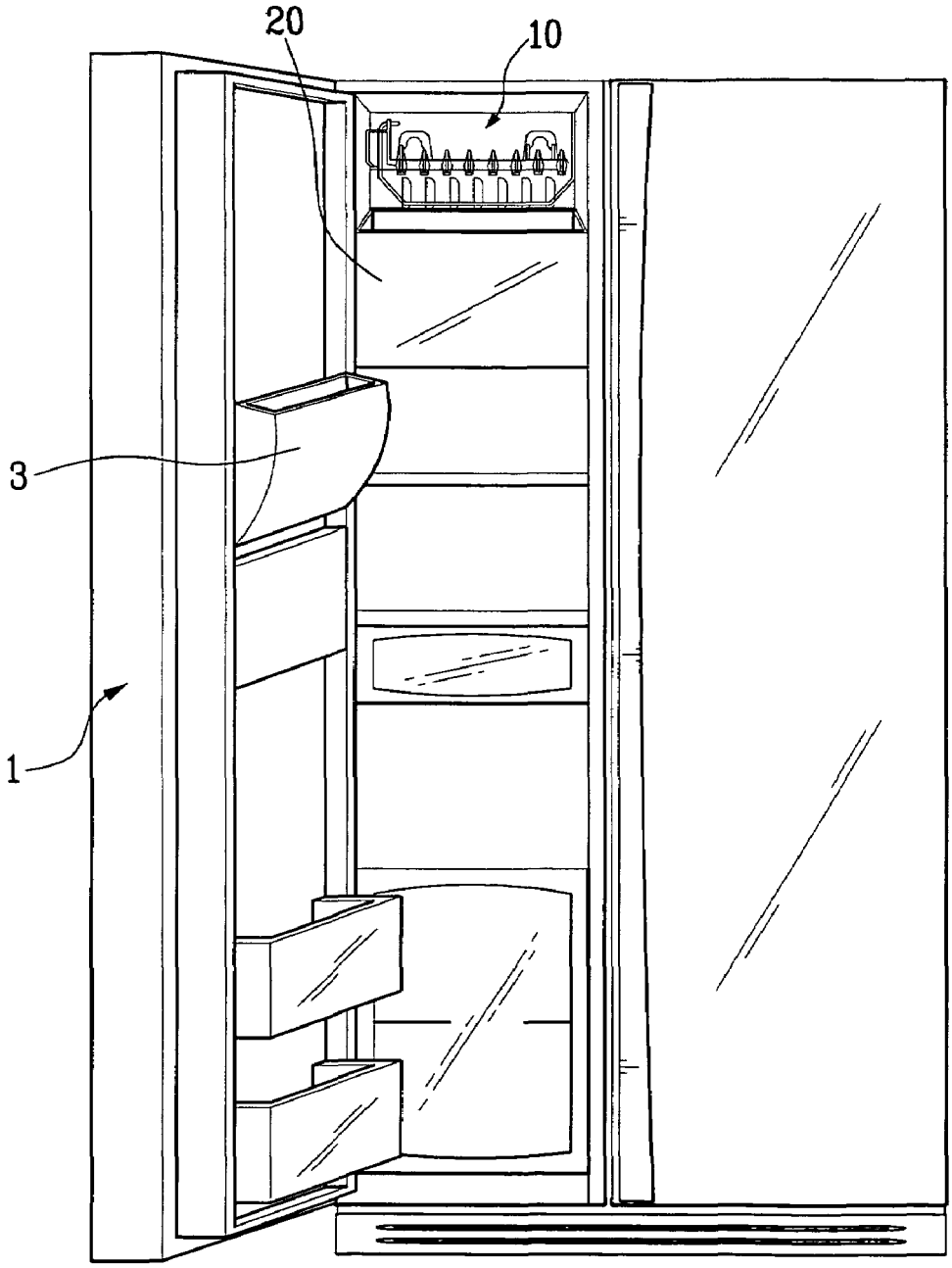
FIG. 2 is a perspective view illustrating the inside of a refrigerator having an ice supplying device according to the first embodiment of the present invention.

Referring to FIG. 2, an icemaker 10 and a container 20 are provided in the freezer. In this case, the container 20 is provided below the icemaker 10. Also, an ice chute 3 is provided in the door 1 so as to connect the container 20 with the dispenser 2 of FIG. 1. Accordingly, the ice made in the icemaker 10 is stored in the container 20, and then is supplied to the dispenser 2 through the ice chute 3.

Figure 3:
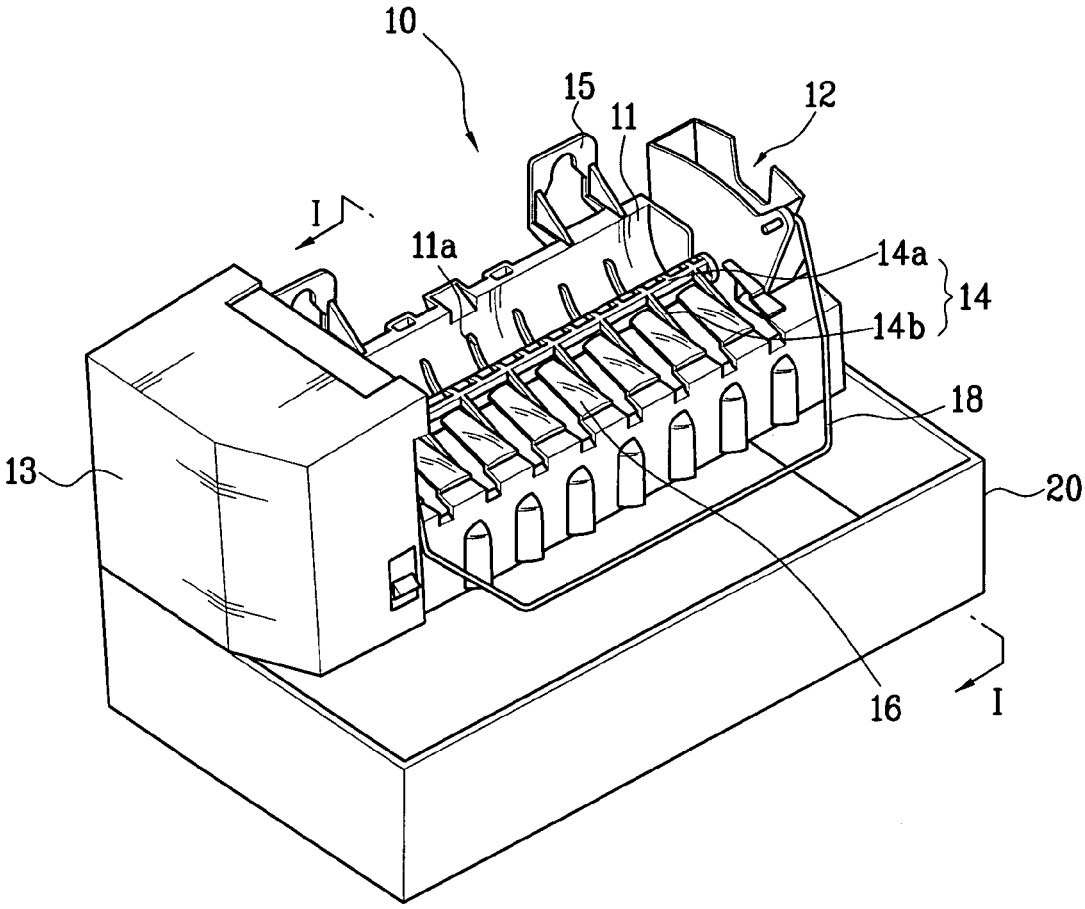
FIG. 3 is a perspective view illustrating an icemaker and a container in the ice supplying device of FIG. 2.

As shown in FIG. 3, the icemaker 10 is provided with an ice tray 11, a water supplying part 12, an ejector 14, and a motor 13. At this time, the ice tray 11 is formed in a semi-cylindrical shape for storing water and ice therein, and the ice tray 11 has an open top part.

A plurality of ribs 11*a* are provided in the ice tray 11 for dividing the inner space of the ice tray 11 into a plurality of sections. Thus, it is possible to make many pieces of ice in the sections divided by the ribs 11*a* of the ice tray 11.

The water supplying part 12 is provided at one side of the ice tray 11 so as to supply the water to the ice tray 11. Also, a bracket 15 is provided at the rear of the ice tray 11 so as to fix the icemaker 10 to the freezer 2.

Meanwhile, the ejector 14 is provided with a shaft 14*a* and a plurality of fins 14*b*. In this case, the shaft 14*a* is provided in an upper part of the ice tray 11 along a longitudinal direction for crossing the center thereof, and the plurality of fins 14*b* are provided in approximately perpendicular to the shaft 14*a* on an outer circumferential surface of the shaft 14*a*. Preferably, the plurality of fins 14*b* are provided at fixed intervals along a longitudinal direction of the shaft 14*a*. Especially, the plurality of fins 14*b* are respectively provided in the sections divided by the ribs 11*a* of the ice tray 11.

As shown in FIG. 3, the motor 13 is mounted on an outer circumferential surface of the ice tray 11, and the shaft 14*a* is connected to the motor 13. Accordingly, as the shaft 14*a* is rotated with the motor 13, the fins 14*b* are rotated together. The fins 14*b* push the pieces of ice inside of the ice tray 11, and drops to a lower part of the icemaker 10.

A plurality of strips 16 are provided in a front part of the ice tray 11, i.e., at an upper end of a side opposite to a side where the bracket 15 is provided. Each of the plurality of strips 16 is extended from a front upper part of the ice tray 11 to a part around the shaft 14*a*. In this case, there is a little gap between each of the plurality of strips 16. The fins 14*b* respectively pass through the gap when the shaft 14*a* is rotated.

In the meantime, the fins 14*b* push the pieces of ice in the ice tray 11 when the shaft 14*a* is rotated, so that the pieces of ice are separated from the ice tray 11 and dropped onto the plurality of strips 16. The pieces of ice dropped onto the plurality of strips 16 are dropped again onto the lower part of the icemaker 10, and then are stored in the ice container 20 provided at the lower part of the icemaker 10. Accordingly, it is preferable to form the strips 15 having an upper surface suitable for guiding the pieces of ice separated from the ice tray 11 to the lower side. In this respect, as shown in FIG. 3 and FIG. 5, it is preferable that the strips 16 slope by positioning one side of each strip adjacent to the shaft 14*a* to be higher than the other side provided at the front side of the ice tray 11.

Also, it is required to provide a structure for preventing the pieces of ice from being dropped to the rear side of the ice tray 11. Preferably, as shown in FIG. 3 and FIG. 5, a rear end of the ice tray 11 is positioned to be higher than the shaft 14*a*. That is, the pieces of ice are separated from the ice tray 11 as being moved to the rear side of the ice tray 11 by the fins 14*b*, and then the pieces of ice are smoothly guided to the front side of the ice tray 11, and dropped onto the upper surface of the strips 16.

Figure 5:
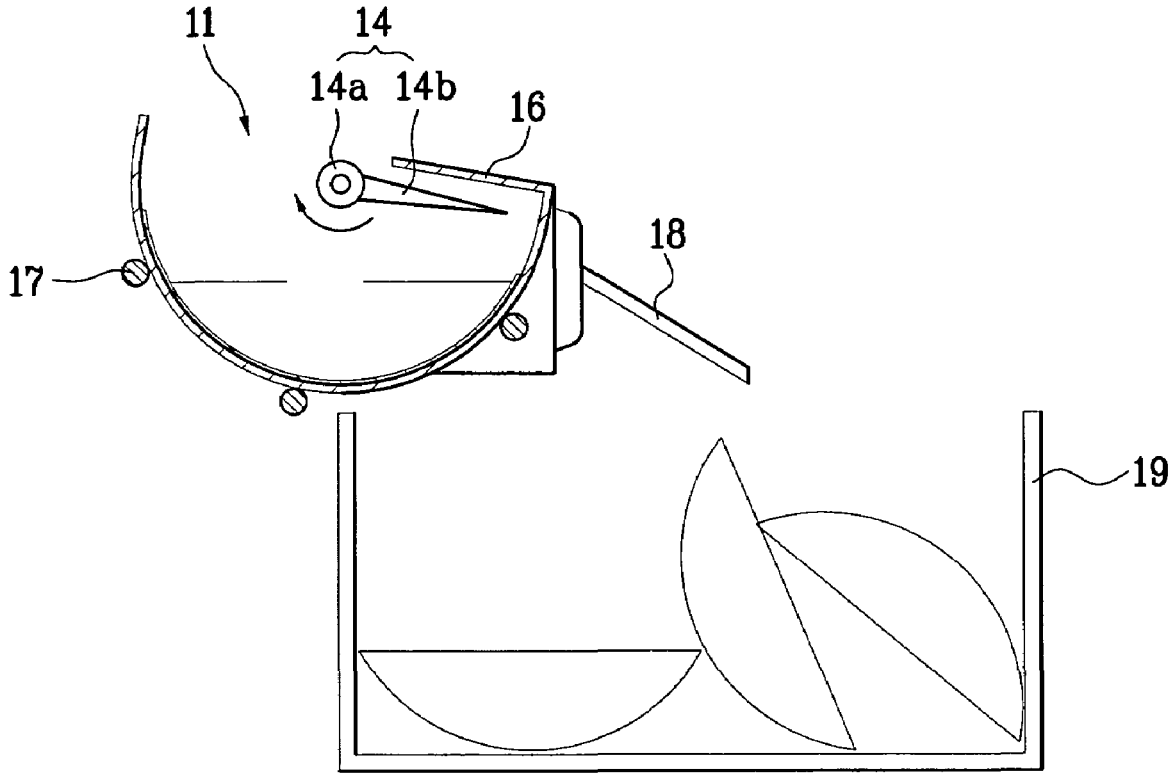
FIG. 5 is a cross-sectional view illustrating ice made in an icemaker and stored in a container of an ice supplying device of FIG. 2.

Meanwhile, as shown in FIG. 5, a heater 17 is provided at a lower surface of the ice tray 11. The heater 17 heats a surface of the ice tray 11 for a short time, and slightly melts the ice on the surface of the ice tray 11. Accordingly, the pieces of ice in the ice tray 11 are easily separated when the shaft 14*a* and the plurality of fins 14*b* rotate.

Also, a sensing arm 18 is provided in the icemaker 10 for measuring the amount of ice stored in the container 20. By a controller (not shown), the sensing arm 18 is moved in up and down directions so as to measure the amount of ice in the container 20. For example, the sensing arm 18 is periodically moved downward. During moving the sensing arm 18 downward, if it is sensed that the amount of ice stored in the container 20 is small, the sensing arm 18 is greatly moved downward. Meanwhile, if it is sensed that the amount of ice stored in the container 20 is large, the sensing arm 18 is bumped into the ice, whereby the sensing arm 18 is moved down at a small degree. Accordingly, the controller measures the amount of ice stored in the container according to the degree of moving the sensing arm 18 downward.

Figure 4:
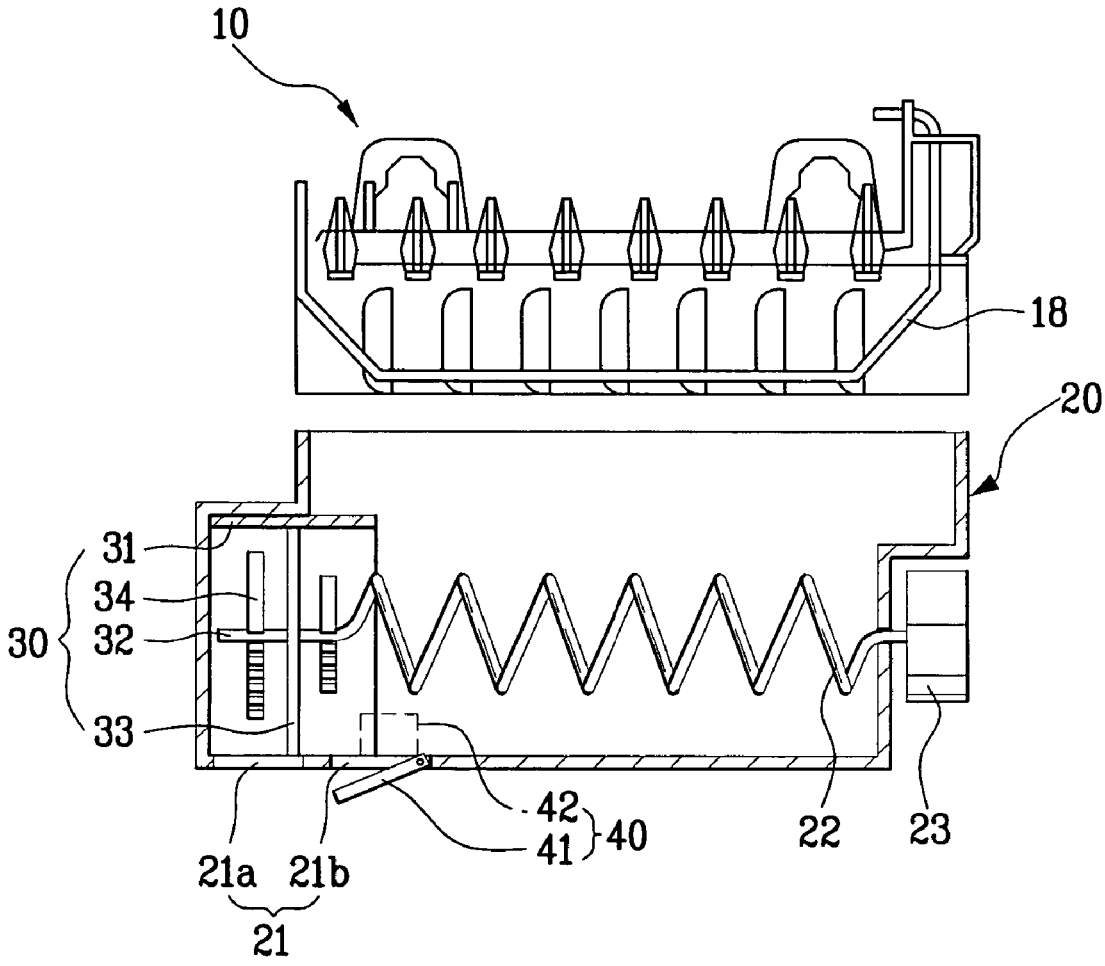
FIG. 4 is a partially cross-sectional view illustrating a crusher, a transporting device and an ice discharger in an ice supplying device of FIG. 2.

As shown in FIG. 3 to FIG. 5, the container 20 is provided at the lower part of the icemaker 10, and has an open top part for receiving and storing the ice dropped from the icemaker 10. Also, an outlet 12 is provided at one side of the container 20, for example, on a floor for discharging the ice to a lower side thereof.

In the meantime, a transporting device 22 is provided in the container 20 for transporting the ice stored in the container 20 toward a side of the outlet 21. As shown in FIG. 4, the transporting device 22 may be provided with an auger crossing the inside of the container 20. The auger is rotated with a motor 23 mounted on an outer surface of the container 20, for example, in the door 1.

Referring to FIG. 4, a crusher 30 is provided in the container 20 so as to crush the pieces of ice transported by the transporting device 22. For example, the crusher 30 is provided for being adjacent to the outlet 21, for example, at the upper part of the outlet 21. In this case, the crusher 30 is provided with a housing 31, a shaft 32, a supporter 33, and a blade 34. Hereinafter, the structure will be described in detail.

The housing 31 is provided above the outlet 21 of the container 20. More particularly, the housing 31 has an open surface facing the transporting device 22.

The shaft 32 is provided in the housing 31 for being in parallel. Also, the shaft 32 is connected to the transporting device 22, whereby the shaft 32 is rotated with the transporting device 22. The shaft 32 may be provided as an additional body being separated from the transporting device 22, and being connected to the transporting device 22. As shown in FIG. 4, the shaft 32 may protrude from one end of the transporting device 22.

The supporter 33 is provided in the housing 31 for supporting the shaft 32. That is, the shaft 32 is provided for penetrating the supporter 33, whereby the shaft 32 is rotated with the transporting device 22 at a predetermined portion of the housing 31.

The blade 34 is connected to the shaft 32, and is rotated with the shaft 32, whereby the ice transported by the transporting device 22 is crushed. In this case, at least one blade 34 is provided. In case the plurality of blades are provided, it is preferable to position the plurality of blades at both sides of the supporter 33.

Meanwhile, in the aforementioned structure, it is possible to selectively supply the crushed or uncrushed ice to the user through the dispenser 2 provided in the door 1. For this, a structure for selectively and correctly discharging the crushed or uncrushed ice through the outlet 21 in a desired amount is required in the ice supplying device of the refrigerator according to the present invention.

Preferably, an ice discharger 40 is provided in the container 20 so as to discharge the ice in the desired amount. As shown in FIG. 4, the ice discharger 40 is provided with an actuator 42 and a shutter 41. At this time, the shutter 41 is formed in a plate type for opening or closing the outlet 21. For example, the actuator 42 is connected to the shutter 41 by a lever (not shown). In this case, the actuator 42 is formed of a solenoid type. In the ice discharger 40 having the aforementioned structure, the actuator 42 is operated according to a control signal of the controller, and the shutter 41 controls an opening or closing amount of the outlet 21 according to the operation of the actuator 42.

Preferably, the ice discharger 40 selectively discharges the ice crushed by the crusher 30, or the ice stored in the container 20. For this, as shown in FIG. 4, the outlet 21 includes a first outlet 21*a* and a second outlet 21*b*. The shutter 41 is provided to selectively open or close the second outlet 21*b*. In this case, the first outlet 21*a* is provided in a lower part of the crusher 30, and the second outlet 21*b* is provided in a lower part of an end portion of the transporting part 22 adjacent to the crusher 30.

In case the outlet 21 and the ice discharger 40 have the aforementioned structure, the ice charger 40 selectively discharges the crushed or uncrushed ice according to the following steps. Hereinafter, this will be described in brief.

If it is desired to supply the crushed ice to the user, the shutter 41 closes the second outlet 21*b*. Then, the ice stored in the container 20 is transported to the crusher 30 by the transporting device 22, and the ice crushed by the crusher 30 is discharged through the open first outlet 21*a*.

In the meantime, if it is desired to supply the uncrushed ice to the user, the shutter 41 opens the second outlet 21*b*. Then, the ice stored in the container 20 is discharged through the second outlet 21*b* before the ice stored in the container 20 is transported to the crusher 30 by the transporting device 22, whereby it is possible to supply the uncrushed ice to the user.

Meanwhile, the structure for selectively supplying the crushed or uncrushed ice is not limited to the structure mentioned above. For example, one outlet and one shutter for controlling the opening and closing amount of the outlet may be provided. In other words, the ice is discharged after being crushed by the crusher 30 when the shutter slightly opens the outlet, and the ice is discharged without being crushed when the shutter completely opens the outlet.

Hereinafter, an operation of the refrigerator having the aforementioned structure according to the present invention will be described as follows.

By operating the sensing arm 18, if the controller (not shown) determines that the ice is the container 20 is insufficient, the icemaker 10 supplies the water to the water supplying part 12. Then, the water supplied to the water supplying part 12 is filled up the space between each of the plurality of ribs 11*a* in the ice tray 11, and is frozen by cool air of the freezer 2. Therefore, a plurality of pieces of ice, each having a predetermined size, are produced in the ice tray 11 by the ribs 11*a*.

When the pieces of ice are made after a lapse of a predetermined time period, the heater 17 is operated for a short time period. Thus, the surface of the ice tray 11 is melt slightly, and the pieces of ice are separated from the ice tray 11. Subsequently, as the motor 13 is operated, the shaft 14*a* and the fins 14*b* are rotated together. Then, the fins 14*b* push the pieces of ice between each of ribs 11*a* in a circumferential direction of the ice tray 11, and the pieces of ice separated from the ice tray 11 by the fins 14*b* are dropped onto the lower part of the icemaker 10. Then, the ice dropped onto the lower part of the icemaker 10 is stored in the container 20.

According as the aforementioned process steps are repeated, when the pieces of ice are filled in the container 20 at a predetermined amount, the controller measures the amount of ice by the sensing arm 18, and stops the process of making the ice. In case the sensing arm 18 determines that the amount of the ice is still not enough, the controller keeps the process of making and storing the ice in the container 20 by repeating the aforementioned process steps.

Meanwhile, if the user operates a control panel on the outer surface of the door 1 when the container 20 is filled up with the ice, the user is supplied with the crushed or uncrushed ice through the dispenser 2. Hereinafter, the process will be described in detail.

When the user selects a function for supplying the crushed ice by operating the control panel, as mentioned above, the shutter 41 closes the second outlet 21*b* or slightly opens the outlet 21. In this case, the motor 23 rotates and transports the large-sized piece of ice stored in the container 20 to the crusher 30. Then, all of ice stored in the container 20 is transported to the crusher 30. Accordingly, the ice crushed by the crusher 30 is discharged through the first outlet 21*a*. The discharged ice is supplied to the user through the dispenser.

On the other hand, when the user selects a function for supplying large-sized and uncrushed ice by operating the control panel, the shutter 41 opens the second outlet 21*b* or mostly opens the outlet 21. Then, the ice transported toward the crusher 30 by the transporting device 22 is discharged through the outlet 21 before reaching the crusher 30, and is supplied to the user through the dispenser.

As mentioned above, the user is selectively supplied with the crushed or uncrushed ice through the dispenser 2 without opening the door 1 in the refrigerator according to the present invention. Furthermore, in case the water tank (not shown) is provided in the refrigerator according to the present invention, it is possible to supply the water and ice to the user through the dispenser 2, thereby obtaining a user's convenience.

However, despite of these advantages, the refrigerator according to the present invention has the following disadvantages.

First, the large-sized icemaker 10 and the container 20 are provided in the freezer, so that it is impossible to improve efficiency in using the space inside the freezer. Especially, if the transporting device 22, the crusher 30 and the ice discharger 40 are provided in the container 20, the size of the container 20 increases, whereby the useful space of the freezer becomes small.

Accordingly, it is required to improve the structure so as to improve efficiency in using the space of the freezer. In order to overcome these problems, an ice supplying device of a refrigerator according to the second and third embodiments of the present invention is proposed.

Hereinafter, the ice supplying device of the refrigerator according to the second and third embodiments of the present invention will be described with reference to FIG. 6 to FIG. 9, in which the same reference numbers will be used through the drawings to refer to the same parts with those according to the first embodiment of the present invention explained with reference to FIG. 2 to FIG. 5.

Figure 6:
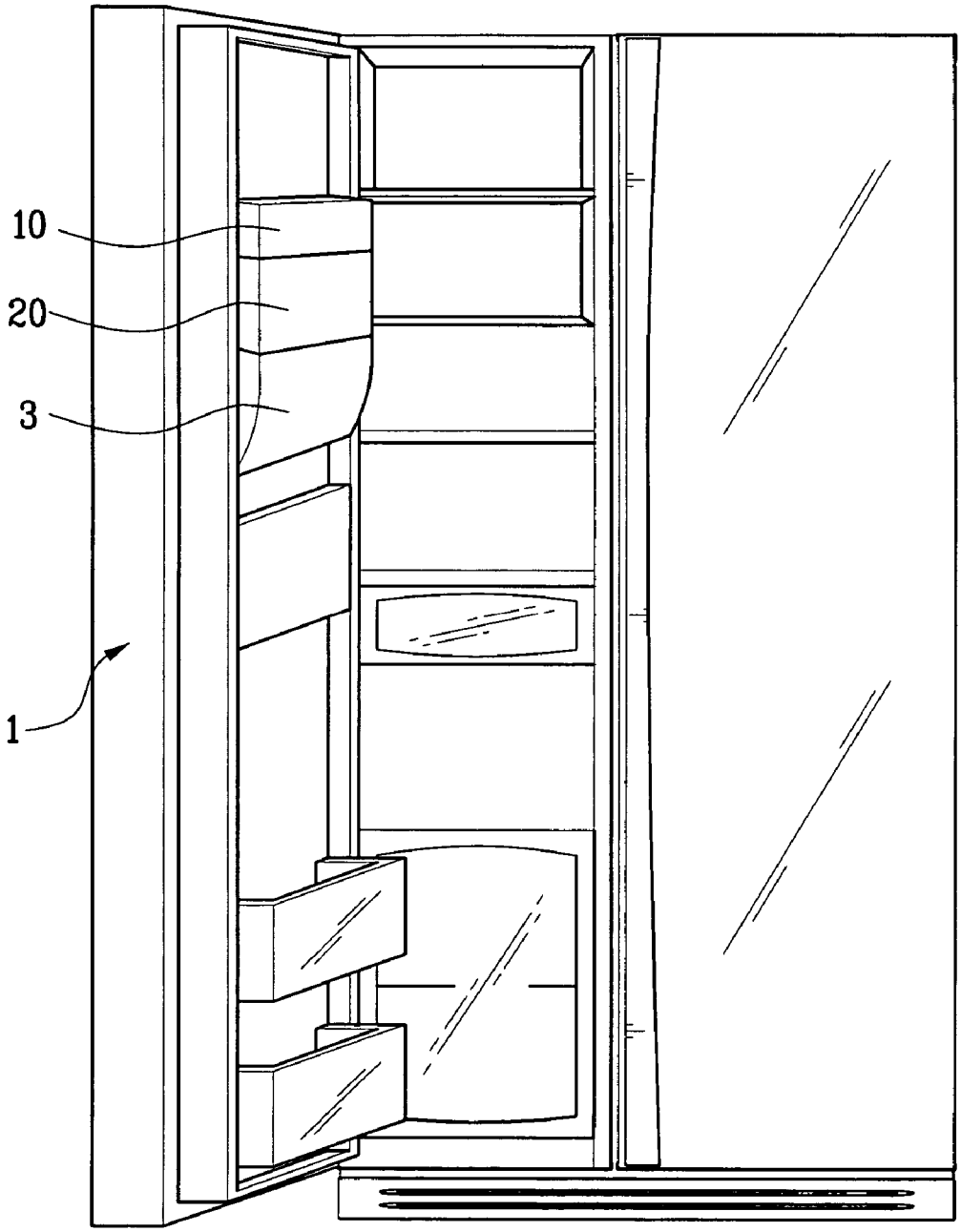
FIG. 6 is a perspective view illustrating the inside of a refrigerator having an ice supplying device according to the second and third embodiments of the present invention.

In the ice supplying device of the refrigerator according to the second and third embodiments of the present invention, an icemaker 10 is mounted in a freezer or the inside of a door 1. For reference, FIG. 6 illustrates the example in which the icemaker 10 is mounted in the door 1. In this case, the icemaker 10 has the similar structure to that shown in FIG. 3. However, the icemaker 10 according to the second and third embodiments of the present invention may be mounted in the door 1. That is, it is preferable to provide an additional structure for preventing the water in the ice tray 11 from overflowing when the door 1 is opened or closed. Hereinafter, this structure will be described with reference to FIG. 7.

At this time, an ice tray 11 is formed in a semi-cylindrical shape, and has an open top part. Then, a panel 11*b* is upward extended at one side of the open top part of the ice tray 11, whereby the water is guided into the inside of the ice tray 11 by the extended panel 11*b* when the door 1 is opened or closed, thereby preventing the water in the ice tray 11 from overflowing.

Figure 7:
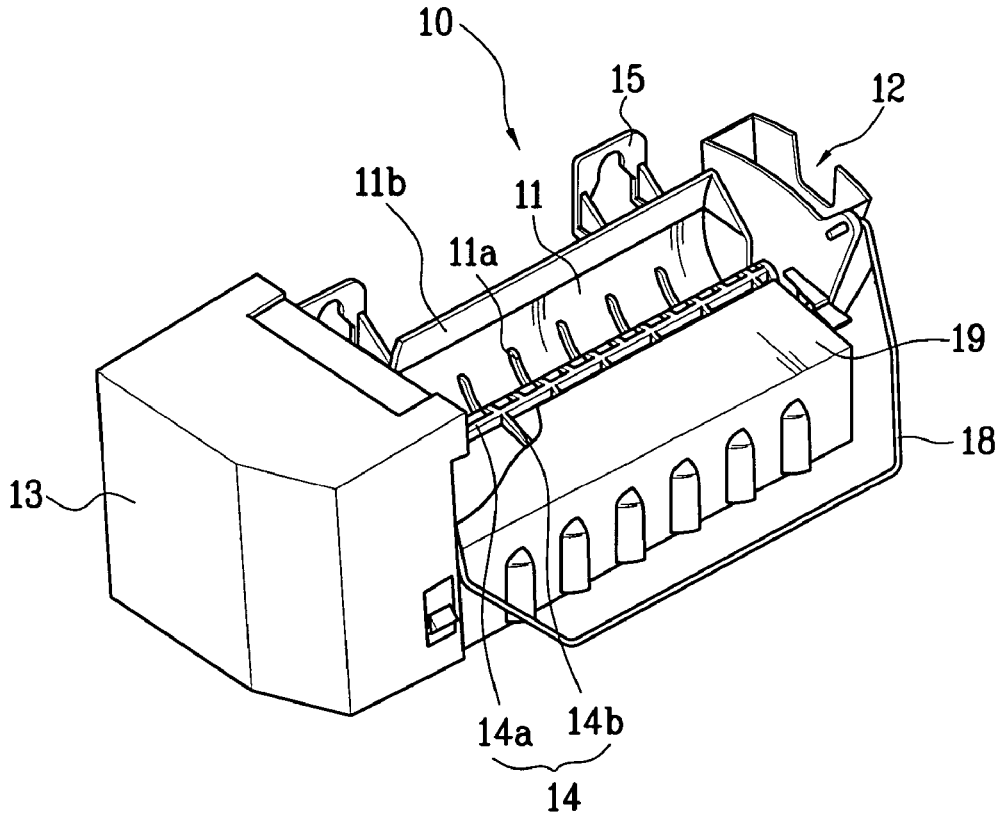
FIG. 7 is a perspective view illustrating an icemaker in an ice supplying device of FIG. 6.

As shown in FIG. 7, one surface of the panel 11 has a curvature consistent with the inner surface of the ice tray 11, whereby it is possible to effectively guide the water sloping in the ice tray 1. Also, when an ejector 14 is rotated, the ice is guided to a strip 19. However, one surface of the panel 11, facing the inner surface of the ice tray 11, may be formed in a flat surface.

The panel 11*b* having the aforementioned structure may be formed in one body with the ice tray 11, or may be formed detachable from the ice tray 11. In case one surface of the panel 11*b* is flat, the ice tray 11 and the panel 11*b* are simultaneously formed in one body by using a mold. However, if one surface of the panel 11*b* has the curvature, it is impossible to simultaneously form the ice tray 11 and the panel 11*b* in one body by using the mold. Accordingly, it is preferable to fabricate the ice tray 11 and the panel 11*b* after separately making the ice tray 11 and the panel 11*b*.

Preferably, as shown in FIG. 7, a top part of the ice tray 11 is partially covered with the strip 19 so as to prevent the water in the ice tray from overflowing when the door 1 is opened or closed. For reference, as mentioned with reference to FIG. 3, the strip 19 is provided to guide the ice discharged through the top part of the ice tray 11 to the container 20.

If the strip 19 partially covers the top part of the ice tray 11, a fin 14*b* of the ejector 14 can't pass through the strip 19. Accordingly, in this case, as shown in FIG. 7, when the ice is completely discharged after the ejector 14 is rotated at a predetermined angle, it is required to reverse-rotate the ejector 14 to an initial point. This structure can be easily obtained according to a method of a motor 13 for rotating a shaft 14*a* is reverse-rotated.

Figure 8A:
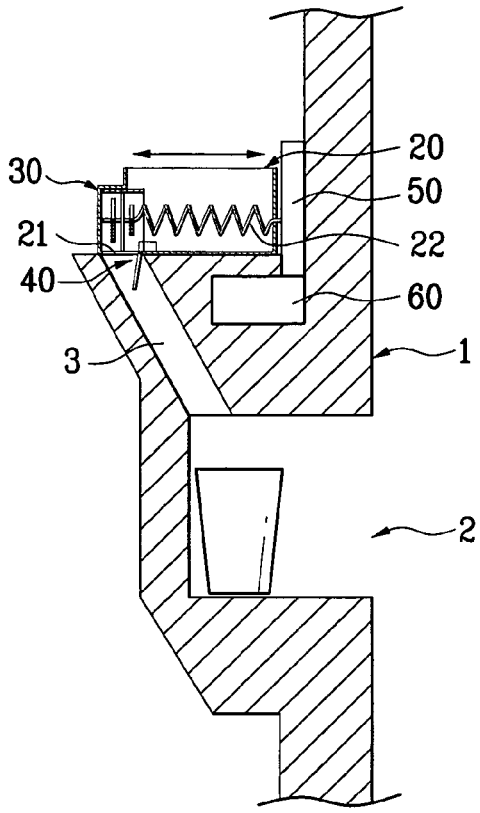
FIG. 8A is a partially cross-sectional view illustrating an ice supplying device mounted in a door according to the second embodiment of the present invention.

As shown in FIG. 8A to FIG. 9B, the container 20 is mounted in the door 1 for being in perpendicular to the inside of the door 1. The container 20 has the similar structure as that explained in FIG. 4, so that the explanation for the container 20 will be omitted. As shown in FIG. 8A and FIG. 9A, the container 20 may be mounted in the door 1 by sliding along a perpendicular direction to the inner surface of the door 1, or may be separated therefrom.

In the aforementioned container 20, an auger is provided as a transporting device 22, as shown in FIG. 8A and FIG.

9A. Also, the auger is provided in the door 1 in perpendicular to the inside of the door 1.

When the auger is provided in perpendicular to the inside of the door 1, a longitudinal side of the container 20 is in perpendicular to the inside of the door 1. In this case, a motor box 50 is positioned between the door 1 and the container 20 so as to rotate the auger. Thus, it is possible to obtain a large space in the inside of the door 1, thereby improving efficiency in using the inside space of the door 1. For example, a shelf may be provided in the inside space of the door 1.

Figure 8B:
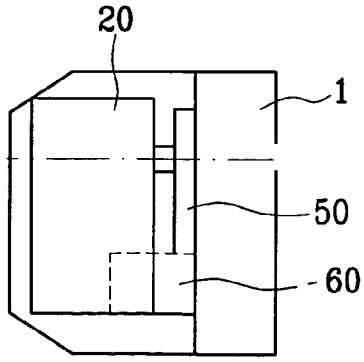
FIG. 8B is a plan view illustrating an ice supplying device of FIG. 8A.

In case the auger is provided in perpendicular to the inside of the door 1, the container 20 may be mounted such that a crusher 30 and an ice discharger 40 are positioned at an opposite side of the door 1, for being near to the freezer, as shown in FIG. 8A and FIG. 8B. In this case, an ice chute 3 connects an outlet 21 of the container 20 with a dispenser 2, and an upper part of the ice chute 3 is provided near to the freezer. Accordingly, as shown in FIG. 8A and FIG. 8B, a control box 60 for controlling the motor box 50 may be mounted in the door 1 below the container 20.

Figure 9A:
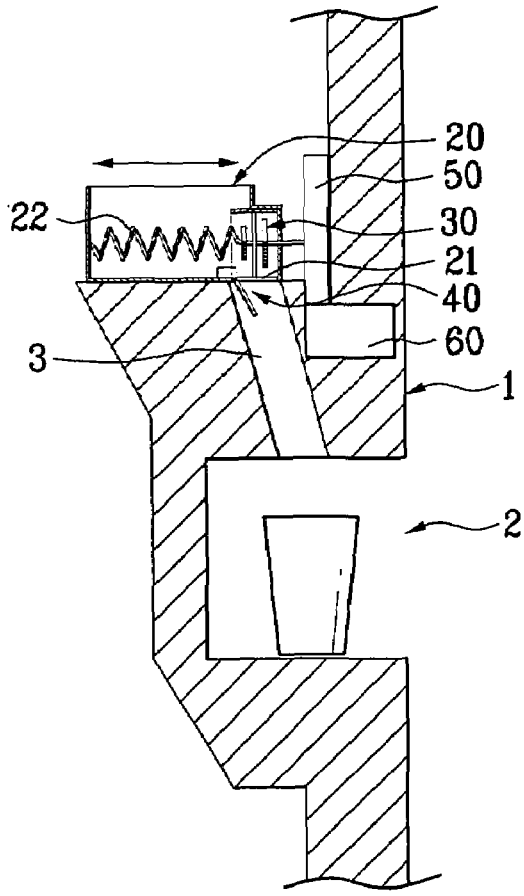
FIG. 9A is a partially cross-sectional view illustrating an ice supplying device mounted in a door according to the third embodiment of the present invention.
Figure 9B:
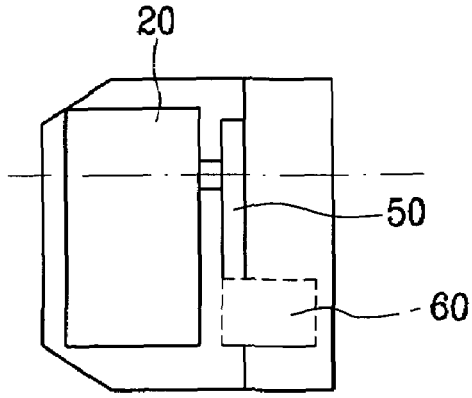
FIG. 9B is a plan view illustrating an ice supplying device of FIG. 9A.

In case the auger is provided in perpendicular to the inside of the door 1, as shown in FIG. 9A and FIG. 9B, the container 20 may be mounted such that the crusher 30 and the ice discharger 40 are provided at a side facing the inside of the door 1. In this case, the upper part of the ice chute 3 is provided near to the inside of the door 1. Thus, as shown in FIG. 9A and FIG. 9B, the control box 60 may be provided near to the outer surface of the door 1.

When the auger is provided in perpendicular to the inside of the door 1, the ice supplying device according to the present invention may be applied to refrigerators having different sizes and capacities in a method of changing the size of the container 20 without changing components such as the transporting device 22 and the crusher 30, thereby improving a product's interchangeability.

Although not shown, the control box 60 for controlling the motor box 50 may be positioned at different portions instead of the portion below the container 20. For example, the control box 60 may be provided on the side of the container 20.

In the ice supplying device according to the second and third embodiments of the present invention, it is preferable to mount and fix the motor box 50 and the control box 60 to the door 1. Preferably, the container 20 may be mounted in the door 1 by sliding, or may be separated from the door 1. Accordingly, when the container 20 is mounted in the door 1, the transporting device 22 is connected to the motor box 50. Meanwhile, if the container 20 is separated from the door 1, the transporting device 22 is separated from the motor box 50.

In this case, the transporting device 22 may be directly connected to the motor box 50. However, it is preferable to connect the transporting device 22 and the motor box 50 with each other by a gear assembly (not shown) so as to rotate the transporting device 22 slowly.

The gear assembly is provided with a first gear (not shown) connected to an axis of the motor box 50, and a second gear (not shown) connected to the transporting device 22 and engaged with the first gear. Although this structure is not shown in the drawings, it can be easily understood to those skilled in the art since this structure is commonly used.

Preferably, the number of teeth in the first gear is smaller than the number of teeth in the second gear. Thus, when the axis of the motor box 50 is rotated at several times, the transporting device 22 is rotated once, whereby the ice is slowly transported toward the outlet 21.

The ice supplying device according to the second and third embodiments of the present invention is operated according to the same method as that in the ice supplying device according to the first embodiment of the present invention explained with reference to FIG. 1 to FIG. 5, whereby the method for operating the ice supplying device according to the second and third embodiments of the present invention will be omitted. However, in the ice supplying device according to the second and third embodiments of the present invention, the container 20 is detachably provided in the door 1 in perpendicular to the inside of the door 1. Thus, the ice supplying device according to the second and third embodiments of the present invention has the more advantages than those in the ice supplying device according to the first embodiment of the present invention.

First, the large-sized container is mounted in the door, thereby improving efficiency in using the inner space of the freezer.

Also, the container is mounted in the inside of the door by sliding along the perpendicular direction of the inside of the door, or separated from the door.

Furthermore, the auger is provided in perpendicular to the inside of the door, so that the ice supplying device according to the present invention may be applied to refrigerators having different sizes and capacities in a method of changing the size of the container without changes of components such as the transporting device and the crusher, thereby improving a product's interchangeability, and decreasing a manufacturing cost.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An ice supplying device of a refrigerator, comprising:

an icemaker for making ice with cool air of a freezer;

a container mounted on a door of the freezer and provided below the icemaker when the door is closed for storing the ice, the container being slidably mountable on and withdrawable from the door along a direction perpendicular to the door;

a dispenser provided on an outer surface of the door; and an ice chute provided in the door so as to allow the container to be in communication with the dispenser.

2. The ice supplying device as darned in claim 1, wherein the icemaker is mounted on the door.

3. The ice supplying device as claimed in claim 1, wherein the icemaker is mounted in the freezer.

4. The ice supplying device as claimed in claim 1, wherein the icemaker includes:

an ice tray for receiving water therein;

a water supplying part for supplying the water to the ice tray;

an ejector provided adjacent to the ice tray and being rotatable so as to discharge the ice of the ice tray; and a strip extending from the ice tray for guiding the ice discharged by the ejector to the container.

5. The ice supplying device as claimed in claim 4, wherein the strip partially covers an upper part of the ice tray so as to prevent the water in the ice tray from overflowing when the door is opened or closed.

6. The ice supplying device as claimed in claim 4, further comprising a panel extending from an upper part of the ice tray upward so as to prevent the water in the ice tray from overflowing when the door is opened or closed.

7. The ice supplying device as claimed in claim 1, wherein the container includes:

an outlet provided at one side thereof; and a transporting device rotatable by a motor and provided in the container so as to transport the ice stored in the container to the outlet.

8. The ice supplying device as claimed in claim 7, wherein the transporting device is formed of an auger crossing the inside of the container.

9. The ice supplying device as claimed in claim 8, wherein the auger is provided in the container perpendicular to the door.

10. The ice supplying device as clamed in claim 7, further comprising a crusher for crushing the ice transported by the transporting device, wherein the crusher is positioned adjacent to the outlet.

11. The ice supplying device as claimed in claim 10, wherein the crusher includes:

a shaft rotatable in the container; and at least one blade extending from the shaft and being rotatable with the shaft so as to crush the ice.

12. The ice supplying device as claimed in claim 11, wherein the shaft and the transporting device being connected to each other are rotatable together.

13. The ice supplying device as claimed in claim 7, wherein the motor is mounted in the door.

14. The ice supplying device as claimed in claim 7, wherein the motor and the transporting device are connected to or separated from each other when the container is mounted on or separated from the door, respectively.

15. The ice supplying device as claimed in claim 7, further comprising an ice discharger provided below the container, so as to control an opening or closing amount of the outlet.

16. The ice supplying device as claimed in claim 15, wherein the ice discharger includes:

an actuator being operated according to a signal of a controller; and a shutter for controlling the opening or closing amount of the outlet according to the operation of the actuator.

17. An ice supplying device of a refrigerator, comprising:

an icemaker for making ice with cool air of a freezer;

a container mounted on a door of the freezer and provided below the icemaker when the door is closed for storing the ice;

a dispenser provided on an outer surface of the door; and an ice chute provided in the door so as to allow the container to be in communication with the dispenser;

wherein the icemaker includes:

an ice tray for receiving water therein;

a water supplying part for supplying the water to the ice tray;

an ejector provided adjacent to the ice tray and being rotatable so as to discharge the ice of the ice tray; and a strip extending from the ice tray for guiding the ice discharged by the ejector to the container, the strip partially covering an upper part of the ice tray so as to prevent the water in the ice tray from overflowing when the door is open or closed.

18. An ice supplying device of a refrigerator, comprising:

an icemaker for making ice with cool air of a freezer;

a container mounted on a door of the freezer and provided below the icemaker when the door is closed for storing the ice;

a dispenser provided on an outer surface of the door; and an ice chute provided in the door so as to allow the container to be in communication with the dispenser;

wherein the icemaker includes:

an ice tray for receiving water therein;

a water supplying part for supplying the water to the ice tray;

an ejector provided adjacent to the ice tray and being rotatable so as to discharge the ice of the ice tray;

a strip extending from the ice tray for guiding the ice discharged by the ejector to the container; and a panel extending from an upper part of the ice tray upward so as to prevent the water in the ice tray from overflowing when the door is open or closed.

19. An ice supplying device of a refrigerator, comprising:

an icemaker for making ice with cool air of a freezer;

a container mounted on a door of the freezer and provided below the icemaker when the door is closed for storing the ice, the container including:

an outlet provided at one side thereof; and a transporting device rotatable by a motor and provided in the container so as to transport the ice stored in the container to the outlet, the transporting device being formed of an auger crossing the inside of the container, the auger being provided in the container perpendicular to the door;

a dispenser provided on an outer surface of the door; and an ice chute provided in the door so as to allow the container to be in communication with the dispenser.

* * * * *